US009551314B2

(12) United States Patent
Tada et al.

(10) Patent No.: US 9,551,314 B2
(45) Date of Patent: Jan. 24, 2017

(54) INTERNAL COMBUSTION ENGINE IGNITION COIL APPARATUS

(71) Applicant: Mitsubishi Electric Corporation, Tokyo (JP)

(72) Inventors: Nobuyuki Tada, Tokyo (JP); Yuusuke Naruse, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 43 days.

(21) Appl. No.: 14/662,335

(22) Filed: Mar. 19, 2015

(65) Prior Publication Data

US 2016/0115935 A1 Apr. 28, 2016

(30) Foreign Application Priority Data

Oct. 23, 2014 (JP) ..... 2014-216091

(51) Int. Cl.

| | |
|---|---|
| ***F02P 3/04*** | (2006.01) |
| ***H01T 15/00*** | (2006.01) |
| *F02P 3/02* | (2006.01) |
| *F02P 3/01* | (2006.01) |
| *F02P 9/00* | (2006.01) |
| *H01T 13/00* | (2006.01) |

(52) U.S. Cl.

CPC ..... *F02P 3/04* (2013.01); *H01T 15/00* (2013.01); *F02P 3/01* (2013.01); *F02P 3/02* (2013.01); *F02P 3/0407* (2013.01); *F02P 9/007* (2013.01); *H01T 13/00* (2013.01)

(58) Field of Classification Search

CPC ..... F02P 3/02; F02P 3/04; F02P 3/01; F02P 3/0407; F02P 9/007; H01T 15/00; H01T 13/00

USPC ..... 123/169 PA

See application file for complete search history.

(56) References Cited

U.S. PATENT DOCUMENTS 4,082,980 A * 4/1978 Yoshikawa ..... H01T 13/06 313/135
4,123,688 A * 10/1978 Yoshikawa ..... H01T 13/04 123/169 R
4,638,268 A * 1/1987 Watanabe ..... H01P 1/262 333/22 F
4,671,586 A * 6/1987 DeBolt ..... H01T 13/05 439/126

(Continued)

FOREIGN PATENT DOCUMENTS

JP 2006-310775 A 11/2006

*Primary Examiner* — Hieu T Vo
*Assistant Examiner* — Arnold Castro
(74) *Attorney, Agent, or Firm* — Sughrue Mion, PLLC; Richard C. Turner

(57) ABSTRACT

In an internal combustion engine ignition coil apparatus, a high-voltage supplying portion has: a protector that is bonded to an ignition coil main body, an electrical conductor, and a resistor that is connected in series between the ignition coil main body and the electrical conductor, and that reduces conductive noise. An electromagnetic wave absorber that shields radiated noise that is generated in the high-voltage supplying portion is mounted to an engine block so as to surround the protector and the resistor. An end surface of the resistor near the ignition coil main body is disposed so as to be aligned with an end surface of the electromagnetic wave absorber near the ignition coil main body.

3 Claims, 3 Drawing Sheets

(56) References Cited

U.S. PATENT DOCUMENTS 4,841,259 A * 6/1989 Mayer ..... H01B 11/12 333/17.2
5,026,294 A * 6/1991 Hisatomi ..... H01R 13/631 439/125
5,163,838 A * 11/1992 Tura, Jr. ..... H01R 13/2421 123/169 PA
5,377,652 A * 1/1995 Noble ..... F02P 3/02 123/634
5,411,006 A * 5/1995 Noble ..... F02P 3/02 123/634
5,550,704 A * 8/1996 Morita ..... H01F 38/12 123/634
6,178,957 B1 * 1/2001 Widiger ..... F02P 3/02 123/634
6,276,348 B1 * 8/2001 Skinner ..... F02P 3/02 123/634
6,360,706 B1 * 3/2002 Skinner ..... H01T 13/04 123/169 PH
6,396,277 B1 * 5/2002 Fong ..... F02P 3/02 324/388
6,456,181 B2 * 9/2002 Nakamura ..... F02P 3/02 336/90
6,463,918 B1 * 10/2002 Moga ..... F02P 3/02 123/633
6,793,863 B1 * 9/2004 Himes, II ..... B29C 45/14491 264/262
6,810,847 B1 * 11/2004 Jefferson ..... H01R 13/6485 123/169 E
6,926,266 B1 * 8/2005 Paul ..... F02P 3/02 267/174
7,124,725 B2 * 10/2006 Kishimoto ..... F02P 13/00 123/169 PA
7,455,537 B2 * 11/2008 Steinhardt ..... H01T 13/05 123/169 P
8,839,752 B2 * 9/2014 Burrows ..... H01T 13/50 123/143 B
2005/0045133 A1 * 3/2005 Matsuda ..... H01T 13/06 123/169 PH
2006/0162685 A1 * 7/2006 Cheng ..... H01T 13/04 123/169 R
2007/0024118 A1 * 2/2007 Torres ..... H03K 17/08128 307/10.1
2009/0007893 A1 * 1/2009 Kato ..... F02P 23/04 123/596
2011/0126811 A1 * 6/2011 Kim ..... H01F 38/12 123/634
2012/0260899 A1 * 10/2012 Yamada ..... F02P 3/04 123/606
2013/0298887 A1 * 11/2013 Lewandowski ..... H01T 13/05 123/647
2014/0328002 A1 * 11/2014 Silva ..... H01T 13/05 361/254

* cited by examiner

INTERNAL COMBUSTION ENGINE IGNITION COIL APPARATUS

BACKGROUND OF THE INVENTION

1. Field of the Invention

The present invention relates to an internal combustion engine ignition coil apparatus that is mounted to an internal combustion engine of an automobile, for example, and that supplies a high voltage to a spark plug to generate a spark discharge.

2. Description of the Related Art

In conventional internal combustion engine ignition coil apparatuses, a high voltage is generated in a secondary coil by passing and interrupting an electric current (a primary electric current) through a primary coil of an ignition coil main body using a switching element, to generate a spark discharge in a spark plug. A resistor is connected in series between the secondary coil and the spark plug in order to suppress conductive noise that is conducted toward the ignition coil main body. An electromagnetic wave absorber is disposed on an outer circumference of an insulating pipe portion so as to cover between at least the resistor and the spark plug in order to suppress externally radiated noise (see Patent Literature 1, for example).

CITATION LIST

Patent Literature

[Patent Literature 1]

Japanese Patent Laid-Open No. 2006-310775 (Gazette)

In conventional internal combustion engine ignition coil apparatuses such as that described above, the resistor may be exposed through the electromagnetic wave absorber, or the resistor may be disposed completely inside the electromagnetic wave absorber, an end portion of the resistor near the ignition coil main body being disposed nearer to the spark plug than an end portion of the electromagnetic wave absorber near the ignition coil main body.

However, because reduction of conductive noise is not complete until after passage through the resistor, radiated noise that is radiated by the resistor cannot be sufficiently suppressed by the electromagnetic wave absorber if the resistor is exposed from the electromagnetic wave absorber.

If the resistor is disposed inside the electromagnetic wave absorber, then sufficient noise suppressing effects cannot be achieved because radiated noise that is reflected diffusely inside the electromagnetic wave absorber is superposed over conductors that are nearer to the ignition coil main body than the resistor, becoming conductive noise and propagating toward the ignition coil main body.

SUMMARY OF THE INVENTION

The present invention aims to solve the above problems and an object of the present invention is to provide an internal combustion engine ignition coil apparatus that can reduce conductive noise and radiated noise more efficiently.

In order to achieve the above object, according to one aspect of the present invention, there is provided an internal combustion engine ignition coil apparatus including: an ignition coil main body that generates a high voltage for ignition; a high-voltage supplying portion that includes: a tubular protector that is made of an insulating material, that is bonded to the ignition coil main body; an electrical conductor that is disposed inside the protector, and that supplies the high voltage that is generated by the ignition coil main body to a spark plug that is mounted to an engine block; and a resistor that is connected in series between the ignition coil main body and the electrical conductor, and that reduces conductive noise; and an electromagnetic wave absorber that shields radiated noise that is generated in the high voltage supplying portion, wherein: the electromagnetic wave absorber is mounted to the engine block so as to surround the protector and the resistor; and an end surface of the resistor near the ignition coil main body is disposed so as to be aligned with an end surface of the electromagnetic wave absorber near the ignition coil main body.

In an internal combustion engine ignition coil apparatus according to the present invention, because the electromagnetic wave absorber is mounted onto the engine block so as to surround the protector and the resistor, and the end surface of the resistor near the ignition coil main body is disposed so as to be aligned with the end surface of the electromagnetic wave absorber near the ignition coil main body, conductive noise and radiated noise can be reduced more efficiently.

DETAILED DESCRIPTION OF THE PREFERRED EMBODIMENTS

Preferred embodiments of the present invention will now be explained with reference to the drawings.

Embodiment 1

Figure 1:
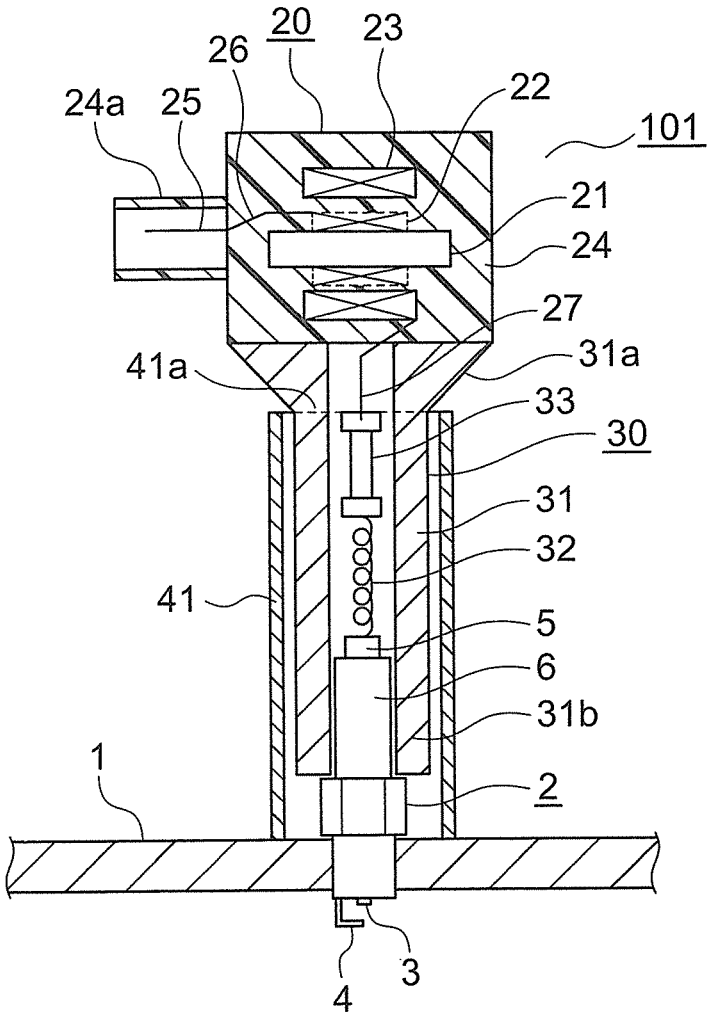
FIG. 1 is a cross section that shows a state in which an internal combustion engine ignition coil apparatus according to Embodiment 1 of the present invention is mounted to an engine block.

FIG. 1 is a cross section that shows a state in which an internal combustion engine ignition coil apparatus according to Embodiment 1 of the present invention is mounted to an engine block. A spark plug 2 is mounted to an engine block (an engine head) 1. The spark plug 2 has a center electrode 3, a ground electrode 4, a connecting terminal 5, and an electrical insulator 6.

An internal combustion engine ignition coil apparatus 101 has: an ignition coil main body 20 that generates a high voltage for ignition; a high-voltage supplying portion 30 that supplies the high voltage that is generated by the ignition coil main body 20 to the spark plug 2; and a tubular (in this example, cylindrical) electromagnetic wave absorber 41 that surrounds the high-voltage supplying portion 30.

An end portion of the electromagnetic wave absorber 41 near the engine block 1 is fixed and electrically connected to the engine block 1. An opening 41*a* that has an opening diameter of 24 mm is disposed on an end portion of the electromagnetic wave absorber 41 near the ignition coil main body 20.

The ignition coil main body 20 has: a core 21; a primary coil 22 that surrounds the core 21; a secondary coil 23 that surrounds the primary coil 22; a molded resin body 24; a plurality of connector pins 25; a plurality of upstream inserted conductors 26; and a downstream inserted conductor 27.

The core 21, the primary coil 22, and the secondary coil 23 are covered by the molded resin body 24. A tubular connector portion 24*a* that protrudes outward is disposed on the molded resin body 24. The connector pins 25 are disposed inside the connector portion 24*a*. The internal combustion engine ignition coil apparatus 101 delivers electrical signals to and from external portions and electric power by means of the connector pins 25.

The upstream inserted conductors 26 are embedded into the molded resin body 24. The connector pins 25 are electrically connected to the primary coil 22 by means of the upstream inserted conductors 26.

The downstream inserted conductor 27 is electrically connected to the secondary coil 23 inside the molded resin body 24, and outputs the high voltage that is generated by the secondary coil 23. An end portion of the downstream inserted conductor 27 at an opposite end from the secondary coil 23 is led out of the molded resin body 24 and protrudes into the high-voltage supplying portion 30.

The high-voltage supplying portion 30 has: a tubular protector 31 that is made of an insulating material; a spring conductor 32 that functions as an electrical conductor that supplies the high voltage that is generated in the ignition coil main body 20 to the spark plug 2; and a resistor 33 that reduces conductive noise.

The protector 31 is cylindrical, and insulates the high voltage that is supplied to the spark plug 2. The protector 31 has: a first axial end portion 31 a that is bonded to the molded resin body 24; and a second axial end portion 31 b that is made to fit into the electrical insulator 6. An outside diameter in a portion of the protector 31 that is nearer to the ignition coil main body 20 than the electromagnetic wave absorber 41 becomes gradually greater in a cone shape toward the ignition coil main body 20.

The spring conductor 32 is disposed inside the protector 31. An end portion of the spring conductor 32 near the spark plug 2 contacts and is electrically connected to the connecting terminal 5.

The resistor 33 is disposed inside the protector 31. The resistor 33 is connected in series between the downstream inserted conductor 27 and the spring conductor 32. An end surface of the resistor 33 near the ignition coil main body 20 is disposed so as to be aligned with an end of the electromagnetic wave absorber 41 near the ignition coil main body 20. In other words, the end surfaces of the resistor 33 and the electromagnetic wave absorber 41 near the ignition coil main body 20 are positioned level with each other in a high-voltage supplying direction in the high-voltage supplying portion 30.

In an internal combustion engine ignition coil apparatus 101 that is configured as described above, a primary electric current that is supplied from the connector pins 25 flows to the primary coil 22 through the upstream inserted conductors 26. Magnetic energy of magnetic flux that is generated by the primary coil 22 is stored in the core 21. Then, if the primary electric current that flows through the primary coil 22 is abruptly interrupted, a high voltage is generated in the secondary coil 23 by the magnetic energy in the core 21.

The high voltage that is generated is supplied to the spark plug 2 through the downstream inserted conductor 27, the resistor 33, and the spring conductor 32, generating a spark discharge between the center electrode 3 and the ground electrode 4.

When the spark discharge is generated in the spark plug 2, an accompanying electric discharge noise is also generated. A portion of the generated electric discharge noise becomes conductive noise, passes through the spring conductor 32, is damped by the resistor 33, and is then transmitted to the downstream inserted conductor 27. The conductive noise that is transmitted to the downstream inserted conductor 27 is transmitted to the connector pins 25 through the secondary coil 23, the core 21, the primary coil 22, and the upstream inserted conductors 26, and is further transmitted outside the internal combustion engine ignition coil apparatus 101.

Another portion of the generated electric discharge noise is emitted to the air as radiated noise. Because there is a damping effect due to the resistor 33, the level of conductive noise is highest when passing through the spring conductor 32. The radiated noise that is generated by the spring conductor 32 is shielded by the electromagnetic wave absorber 41. Because of that, external leakage of radiated noise at the opening 41*a* at the end portion of the electromagnetic wave absorber 41 near the ignition coil main body 20 is dominant.

Now, if the radiated noise that is generated in the spring conductor 32 and that is reflected diffusely within the electromagnetic wave absorber 41 is superposed onto the downstream inserted conductor 27, then the noise bypasses the resistor 33 and is transmitted toward the ignition coil main body 20, reducing the damping effect of the resistor 33. Because the conductive noise is damped by electrical resistance components as it flows through the resistor 33, external radiated noise increases if the resistor 33 is outside the electromagnetic wave absorber 41.

In answer to that, in the internal combustion engine ignition coil apparatus 101 according to Embodiment 1, because the electromagnetic wave absorber 41 is mounted to the engine block 1 so as to surround the protector 31 and the resistor 33, and the end surface of the resistor 33 is aligned with the end surface of the end portion (the opening portion) of the electromagnetic wave absorber 41, radiated noise that is generated in the spring conductor 32 and is reflected diffusely inside the electromagnetic wave absorber 41 is kept from being superposed over the downstream inserted conductor 27. Because the entire resistor 33 is inside the electromagnetic wave absorber 41, radiated noise from the resistor 33 is shielded by the electromagnetic wave absorber 41.

Thus, according to the internal combustion engine ignition coil apparatus 101 according to Embodiment 1, conductive noise and radiated noise can be reduced more efficiently, enabling the influence of conductive noise and radiated noise on peripheral equipment to be reduced. Ignition system reliability can thereby be improved.

Embodiment 2

Figure 2:
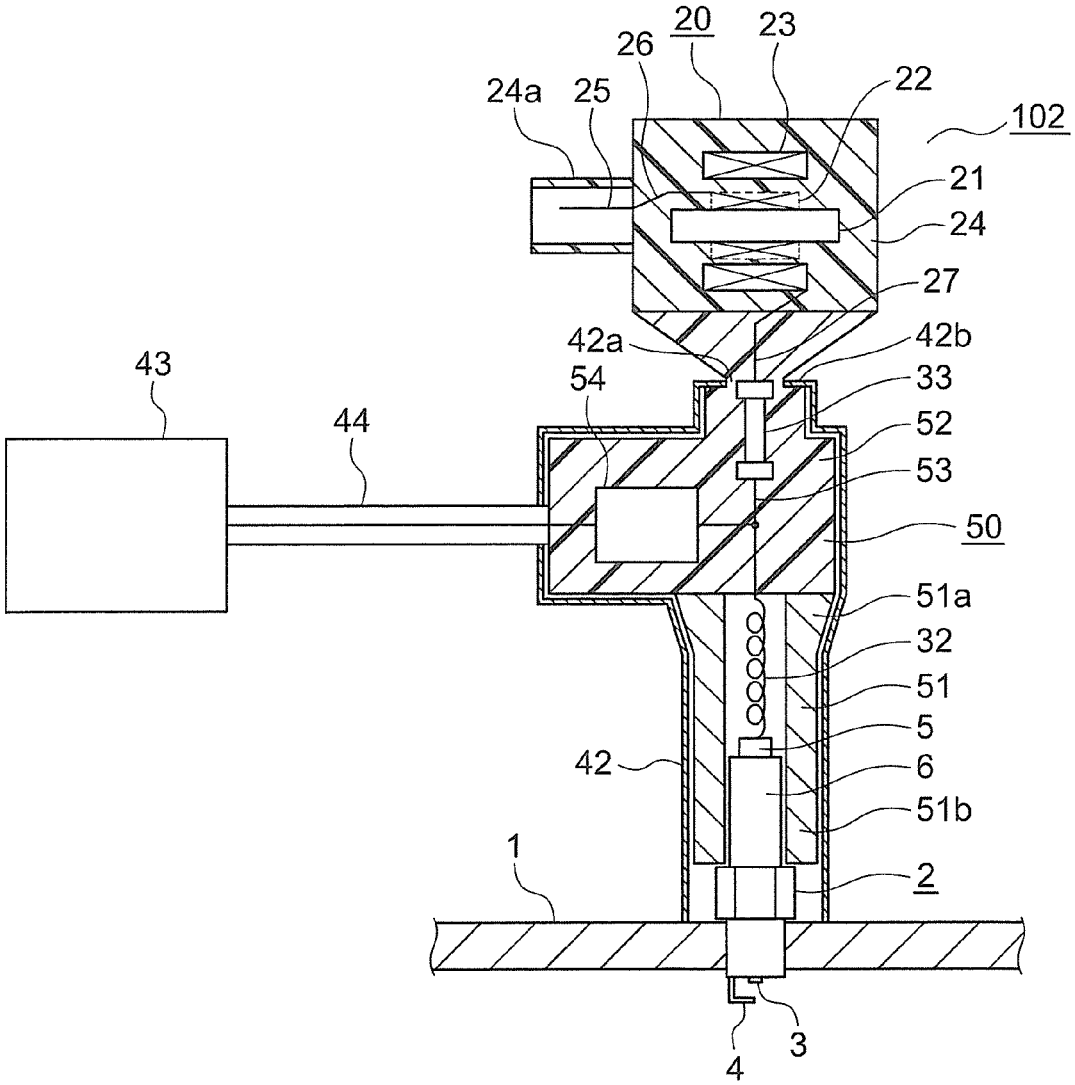
FIG. 2 is a cross section that shows a state in which an internal combustion engine ignition coil apparatus according to Embodiment 2 of the present invention is mounted to an engine block.

Next, FIG. 2 is a cross section that shows a state in which an internal combustion engine ignition coil apparatus according to Embodiment 2 of the present invention is mounted to an engine block. An internal combustion engine ignition coil apparatus 102 according to Embodiment 2 has: an ignition coil main body 20 that is similar or identical to that of Embodiment 1; a high-voltage supplying portion 50 that supplies the high voltage that is generated by the ignition coil main body 20 to a spark plug 2; a tubular electromagnetic wave absorber 42 that surrounds the high-voltage supplying portion 50; an electric power supply unit 43; and an electric power supply cable 44.

An end portion of the electromagnetic wave absorber 42 near the engine block 1 is fixed and electrically connected to the engine block 1. An opening 42*a* that has an opening diameter of 15 mm is disposed on an end portion of the electromagnetic wave absorber 42 near the ignition coil main body 20.

In addition, a ring-shaped flange portion 42*b* that protrudes radially inward is disposed on an end portion of the electromagnetic wave absorber 42 near the engine block 1. An opening 42*a* is disposed centrally on the flange portion 42*b*. Thus, a diameter of the opening 42*a* is smaller than an inside diameter of the electromagnetic wave absorber 42, and is smaller than an outside diameter of a protector 51.

The high-voltage supplying portion 50 has: a tubular protector 51 that is made of an insulating material; a spring conductor 32; a resistor 33; a molded resin body 52; an intermediate inserted conductor 53; and a mixer circuit 54.

The protector 51 is cylindrical, and insulates the high voltage that is supplied to the spark plug 2. The protector 51 has: a first axial end portion 51*a* that is bonded to the molded resin body 52; and a second axial end portion 31*b* that is made to fit into the electrical insulator 6.

The spring conductor 32 is disposed inside the protector 51. An end portion of the spring conductor 32 near the spark plug 2 contacts and is electrically connected to a connecting terminal 5.

The resistor 33, the intermediate inserted conductor 53, and the mixer circuit 54 are disposed inside the molded resin body 52. The intermediate inserted conductor 53 is connected in series between the resistor 33 and the spring conductor 32.

An end surface of the resistor 33 near the ignition coil main body 20 is disposed so as to be aligned with an end of the electromagnetic wave absorber 42 near the ignition coil main body 20. In other words, the end surfaces of the resistor 33 and the electromagnetic wave absorber 42 near the ignition coil main body 20 are positioned level with each other in a high-voltage supplying direction in the high-voltage supplying portion 50. An outside diameter in a portion of the molded resin body 52 that is nearer to the ignition coil main body 20 than the electromagnetic wave absorber 42 becomes gradually greater in a cone shape toward the ignition coil main body 20.

The intermediate inserted conductor 53 branches off at an intermediate portion and is connected to the mixer circuit 54. The electric power supply unit 43 is connected to the mixer circuit 54 by means of the electric power supply cable 44. The electric power supply unit 43 has a shielded construction, and generates a high-frequency electric current that is supplied to the spark plug 2. The electric power supply cable 44 has a shielded construction, and transfers the high-frequency electric current that is generated by the electric power supply unit 43 to the mixer circuit 54.

The mixer circuit 54 is constituted by an inductance and a capacitor, and has a specific resonant frequency. The rest of the configuration is similar or identical to that of Embodiment 1.

Next, operation will be explained. In a similar manner to that of Embodiment 1, when a spark discharge is generated in the spark plug 2, a high-frequency alternating current is generated by the electric power supply unit 43 immediately thereafter. The generated high-frequency electric current is supplied to the spark plug 2 by means of the electric power supply cable 44, the mixer circuit 54, and the intermediate inserted conductor 53, igniting and combusting a fuel-air mixture.

Here, noise is generated by both the generation of the spark discharge and the supplying of the high-frequency electric current from the electric power supply unit 43. A portion of this noise becomes conductive noise, passes through the intermediate inserted conductor 53, is damped by the resistor 33, and is then transmitted to the downstream inserted conductor 27. The conductive noise that is transmitted to the downstream inserted conductor 27 is transmitted to the connector pins 25 through the secondary coil 23, the core 21, the primary coil 22, and the upstream inserted conductors 26, and is further transmitted outside the internal combustion engine ignition coil apparatus 102.

Another portion of the generated noise is emitted to the air as radiated noise. Because there is a damping effect due to the resistor 33, the level of conductive noise is highest when passing through the spring conductor 32 and the intermediate inserted conductor 53. The radiated noise that is generated by the spring conductor 32 and the intermediate inserted conductor 53 is shielded by the electromagnetic wave absorber 42. Because of that, external leakage of radiated noise at the opening 42*a* at the end portion of the electromagnetic wave absorber 42 near the ignition coil main body 20 is dominant.

Here, because the electric power supply cable 44 and the electric power supply unit 43 have shielded constructions, and noise that propagates to the mixer circuit 54, the electric power supply cable 44, and the electric power supply unit 43 is suppressed by the mixer circuit 54, it will not be taken into consideration in the present embodiment.

In an internal combustion engine ignition coil apparatus 102 of this kind, because the electromagnetic wave absorber 42 is mounted to the engine block 1 so as to surround the protector 31 and the resistor 33, and the end surface of the resistor 33 is aligned with the end surface of the end portion (the opening portion) of the electromagnetic wave absorber 42, radiated noise that is generated in the spring conductor 32 and the intermediate inserted conductor 53 and is reflected diffusely inside the electromagnetic wave absorber 42 is kept from being superposed over the downstream inserted conductor 27. Because the entire resistor 33 is inside the electromagnetic wave absorber 42, radiated noise from the resistor 33 is shielded by the electromagnetic wave absorber 42.

Because the diameter of the opening 42*a* is smaller than the outside diameter of the protector 51, a gap between an end portion of the resistor 33 near the ignition coil main body 20 and a circumferential edge portion of the opening 42*a* is reduced, enabling superposition of radiated noise onto the downstream inserted conductor 27 to be suppressed more reliably.

Embodiment 3

Figure 3:
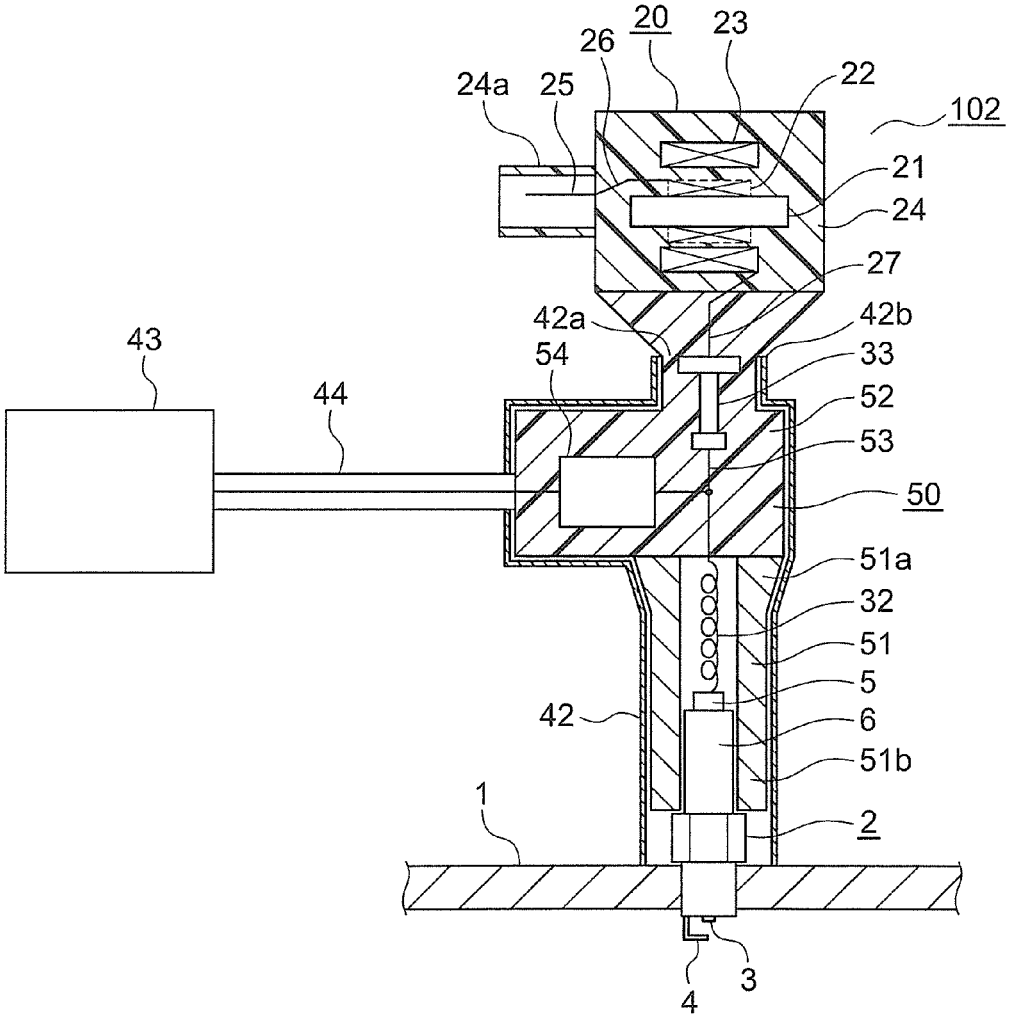
FIG. 3 is a cross section that shows a state in which an internal combustion engine ignition coil apparatus according to Embodiment 3 of the present invention is mounted to an engine block.

Next, FIG. 3 is a cross section that shows a state in which an internal combustion engine ignition coil apparatus according to Embodiment 3 of the present invention is mounted to an engine block. In Embodiment 3, a flange portion 42*b* is not disposed on an electromagnetic wave absorber 42, and an outside diameter of an end portion of a resistor 33 near an ignition coil main body 20 is larger than an outside diameter of an end portion of the resistor 33 near a spring conductor 32. Thus, a gap between the end portion of the resistor 33 near the ignition coil main body 20 and a circumferential edge portion of an opening 42*a* is smaller. A diameter of the opening 42*a* is 24 mm, as was that of Embodiment 1. The rest of the configuration is similar or identical to that of Embodiment 2.

According to a configuration of this kind, superposition of radiated noise onto the downstream inserted conductor 27 can also be suppressed more reliably.

Moreover, in Embodiment 2, the outside diameter of the end portion of the resistor 33 near the ignition coil main body 20 may alternatively be greater than the outside diameter of the end portion of the resistor 33 near the spring conductor 32.

What is claimed is:

1. An internal combustion engine ignition coil apparatus comprising:

an ignition coil main body that generates a high voltage for ignition;

a high-voltage supplying portion that includes:

a tubular protector that is made of an insulating material, that is bonded to the ignition coil main body;

an electrical conductor that is disposed inside the protector, and that supplies the high voltage that is generated by the ignition coil main body to a spark plug that is mounted to an engine block; and a resistor that is connected in series between the ignition coil main body and the electrical conductor, and that reduces conductive noise; and an electromagnetic wave absorber that shields radiated noise that is generated in the high voltage supplying portion, wherein:

the electromagnetic wave absorber is mounted to the engine block so as to surround the protector and the resistor; and an end surface of the resistor near the ignition coil main body is disposed so as to be aligned with an end surface of the electromagnetic wave absorber near the ignition coil main body.

2. The internal combustion engine ignition coil apparatus according to claim 1, wherein an opening diameter of the end portion of the electromagnetic wave absorber near the ignition coil main body is smaller than an outside diameter of the protector.

3. The internal combustion engine ignition coil apparatus according to claim 1, wherein an outside diameter of an end portion of the resistor near the ignition coil main body is greater than an outside diameter of an end portion of the resistor near the electrical conductor.

* * * * *